US005613285A

United States Patent [19]

Chester et al.

[11] Patent Number: 5,613,285

[45] Date of Patent: Mar. 25, 1997

[54] PROCESS FOR MAKING MULTICOLOR MULTIFILAMENT NON COMMINGLED YARN

[75] Inventors: Roy E. Chester, Sylvania, Ga.; Andrew M. Coons, III, Anderson, S.C.; Hugh G. Harrelson, Jr., Anderson, S.C.; Willis M. King, Anderson, S.C.; George E. Potter, Sylvania, Ga.; Carl D. Sanford, Lyerly, Ga.; Patrick C. Smith, Sylvania, Ga.; Melvin R. Thompson, Anderson, S.C.; Leonard C. Vickery, Jr., Anderson, S.C.; Jerry M. Whitfield, Anderson, S.C.

[73] Assignee: BASF Corporation, Mt. Olive, N.J.

[21] Appl. No.: 333,158

[22] Filed: Nov. 1, 1994

[51] Int. Cl.[6] ..... D02G 1/00; D02G 3/22

[52] U.S. Cl. ..... 28/247; 28/258

[58] Field of Search ..... 28/219, 220, 221, 28/247, 258, 262, 263, 264, 265, 266, 267, 271, 274; 264/73, 75; 57/264, 289, 333

[56] References Cited

U.S. PATENT DOCUMENTS

| | | | |
|---|---|---|---|
| 2,869,967 | 1/1959 | Breen | 57/140 |
| 3,780,516 | 12/1973 | Kimbrell | 57/157 |
| 4,025,595 | 5/1977 | Mirhej | 264/103 |
| 4,408,376 | 10/1983 | Hatcher et al. | 28/245 |
| 4,993,130 | 2/1991 | Coons, III et al. | 28/271 |
| 5,148,586 | 9/1992 | Coons | 28/271 |
| 5,220,778 | 6/1993 | Flachmueller et al. | 57/333 |
| 5,251,363 | 10/1993 | Gerhards et al. | 28/221 |
| 5,327,622 | 7/1994 | Coons et al. | 28/273 |

OTHER PUBLICATIONS

Co-pending U.S. Patent Application Serial No. 08/311,660 filed Sep. 23, 1994, Boyer et al., "Multicolor Parallel Spun Yarn Process And Product Made Thereby".

*Primary Examiner*—C. D. Crowder
*Assistant Examiner*—Larry D. Worrell, Jr.

[57] ABSTRACT

The process includes the sequential steps of supplying in a separated side-by-side parallel relationship to a yarn drawing apparatus first multifilament feed yarn and second multifilament feed yarn which are differently colored or colorable with respect to each other; drawing the first feed yarn and the second feed yarn in the yarn drawing apparatus while keeping the first feed yarn and the second feed yarn in a relatively parallel relationship and separate from each other; making a bundle from the first drawn feed yarn and the second drawn feed yarn by simultaneously imparting false twist to the drawn first feed yarn and the drawn second feed yarn without commingling the first and second drawn feed yarns; and texturing the bundle without commingling to make a nontwisted, noncommingled singles yarn displaying two distinct unblended colors.

18 Claims, 9 Drawing Sheets
(4 of 13 Drawing(s) in Color)

PROCESS FOR MAKING MULTICOLOR MULTIFILAMENT NON COMMINGLED YARN

FIELD OF THE INVENTION

The present invention relates to multicolored yarns made from differently colored filaments and processes for making them.

BACKGROUND OF THE INVENTION

As used herein, the following terms have the meanings ascribed:

"Filament or filaments" refer to fibrous strands of extreme or indefinite length. In contrast, "staple fibers" are fibrous strands of definite and short lengths.

"Yarn" refers to a continuous assemblage of filaments twisted or laid together.

"Commingling" refers to blending or mixing together of the filaments of two or more yarns.

"Multicolor yarn" refers to an assemblage of two or more filaments or groups of filaments which are differently colored or colorable with respect to each other.

"Singles yarn" means the simplest unit of yarn suitable for use in, for example, weaving and knitting. One end of BCF (bulked continuous filament) is a singles yarn.

"Space dyed appearance" refers to the effect produced by dyeing yarn at irregular intervals with more than one color along its length.

Yarns made from differently colored or colorable filaments and methods for making them are known. One example of such yarns are heather type yarns. Heather yarns display muted, mixed or diffused color.

Certain other multicolor yarn displays mutually distinguishable colors. For example, U.S. Pat. No. 5,251,363 to Gerhards et al. describes a method and apparatus for producing multicolored crimped yarns. The method includes spinning a plurality of differently colored groups of filaments, subjecting the filaments of each group to a treatment liquid, and then combining the filaments to form respective strands. Each strand is then subjected to an air entangling process, then stretched and the strands are thereafter combined in a thermo-pneumatic texturing process.

U.S. Pat. No. 5,220,778 to Flachmueller et al. describes a method for the production of untwisted yarns from at least two fibril bundles. Intermediate steps which are introduced between the main conventional steps of spinning, stretching and texturing allow the reciprocal position of the individual fibril bundles resulting from the arrangement of the spinnerets to be retained through the process. The patents states that a non-positively acting false twister for each individual fibril bundle, whose strength or thickness can be varied, also makes it possible to vary the mixing of the fibrils of the individual bundles in their contact zones.

U.S. Pat. No. 4,408,376 to Hatcher et al. pertains to the drawing of a plurality of yarns about draw rolls in adjacent untwisted relation. The invention is described as having particular application to the processing of yarn ends, each of which has a different color, which ends are to be subsequently twisted into a single yarn having uniform color properties throughout its length.

U.S. Pat. No. 4,025,595 to Mirhej describes that a range of continuous mixed filament texturing feed yarns will provide a range of fabrics having advantageous mixed filament characteristics that can be prepared in a single process when at least two different continuous filament yarns are co-spun and separately entangled. The process is described as providing yarns which will produce a whole spectrum of mixed filament effects in a fabric ranging from high contrast/high directionality to low contrast/low directionality.

U.S. Pat. No. 3,780,516 to Kimbrell describes a process for forming a yarn wherein a plurality of yarn ends pass from their respective yarn packages, are each wrapped about a common feed roll, passed from the feed roll through a heating zone, passed from the heating zone to a common heated draw roll, are wrapped about the heated draw roll and passed from the heated draw roll through apparatus for bringing the yarn ends into contact with one another in a pre-selected arrangement to form a resulting yarn which has improved properties caused by wrapping a selected one of the yarn ends about the heated draw roll a number of turns which is greater than the common number of turns the other yarn ends are wrapped about the draw roll.

U.S. Pat. No. 5,148,586 to Coons describes a process and apparatus for producing a yarn with a novel heather appearance.

Co-pending U.S. application Ser. No. 08/311,660 describes a process for making distinct color effects in staple yarn.

SUMMARY OF THE INVENTION

The present invention includes a process for making unique distinct color effects in yarns. The process includes the sequential steps of supplying in a separated side-by-side parallel relationship to a yarn drawing apparatus first multifilament feed yarn and second multifilament feed yarn which are differently colored or colorable with respect to each other; drawing the first feed yarn and the second feed yarn in the yarn drawing apparatus while keeping the first feed yarn and the second feed yarn in a relatively parallel relationship and separate from each other; making a bundle from the first drawn feed yarn and the second drawn feed yarn by simultaneously imparting false twist to the drawn first feed yarn and the drawn second feed yarn without commingling the first and second drawn feed yarns; and texturing the bundle without commingling to make a non-twisted, noncommingled singles yarn displaying two distinct unblended colors.

It is an object of the present invention to provide a process for making multicolor multifilament yarn where the individual colors are distinguishable in the finished yarn.

Another object of the present invention is to provide yarn having unique color effects.

Related objects and advantages of the present invention will be apparent to those of ordinary skill in the art after reading the following detailed description.

The file of this patent contains at least one drawing executed in color. Copies of this patent with color drawings will be provided by the Patent and Trademark office upon request and payment of the necessary fee.

DETAILED DESCRIPTION OF THE PREFERRED EMBODIMENTS

To promote an understanding of the principles of the present invention, descriptions of specific embodiments of the invention follow, and specific language describes the same. It will nevertheless be understood that no limitation of the scope of the invention is thereby intended, and that such alterations and further modifications, and such further applications of the principles of the invention discussed are contemplated as would normally occur to one ordinarily skilled in the art to which the invention pertains.

The present invention involves a process for making a multicolor multifilament yarn. When the process of the present invention is employed, the yarn created by the process displays each of its colors distinctly to provide distinct multicolor effects rather than a diffused or blended color effect (like heather). These multicolor effects include, for example, a space-dyed appearance and a "chunky" appearance, i.e., chunks of color in the final yarn. Also, yarns made according to the present invention can be twisted or otherwise combined with other more conventional yarns, including one color yarns, to create a wide variety of unique color effects.

Figure 1:
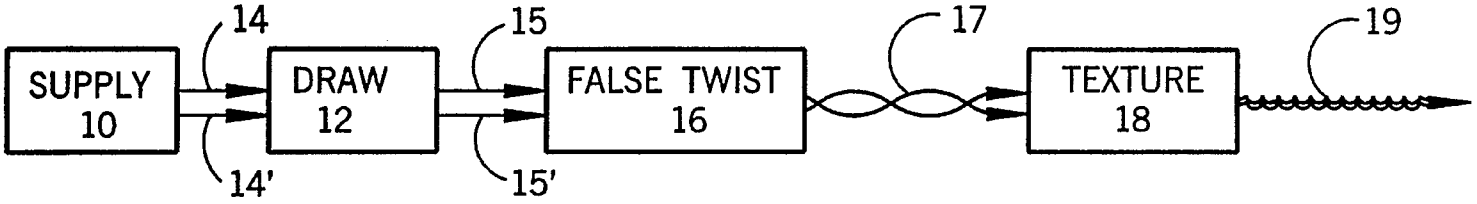
FIG. 1 schematically illustrates a first embodiment of a process according to the present invention.
Figure 1A:
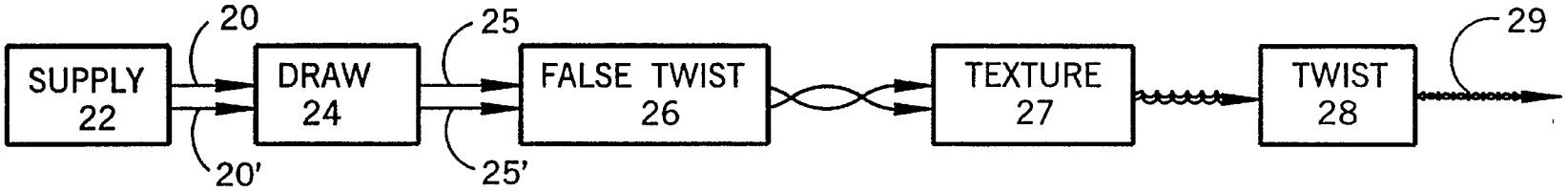
FIG. 1*a* schematically illustrates a second embodiment of a process according to the present invention.
Figure 1B:
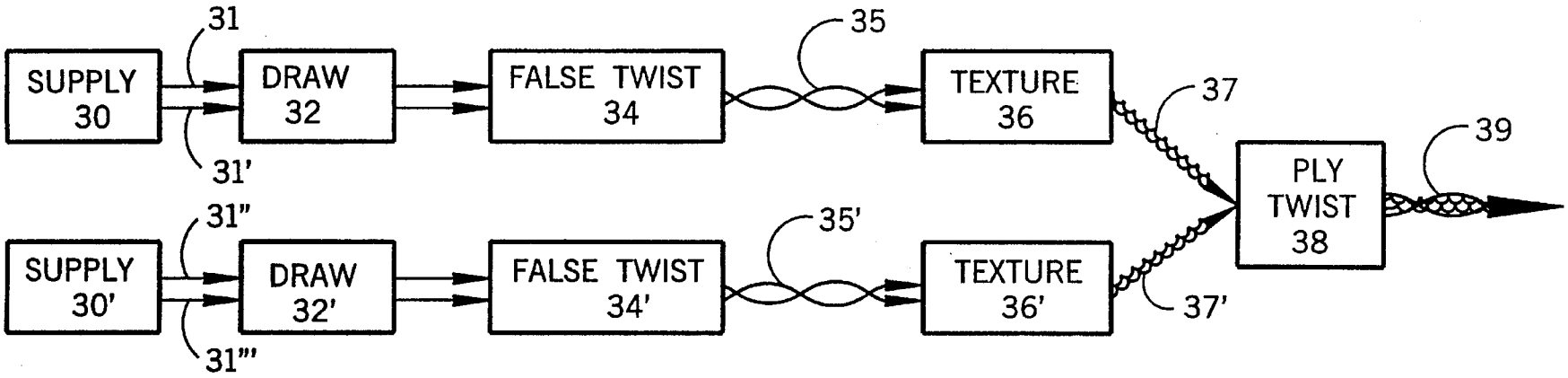
FIG. 1*b* schematically illustrates a third embodiment of a process according to the present invention.
Figure 1C:
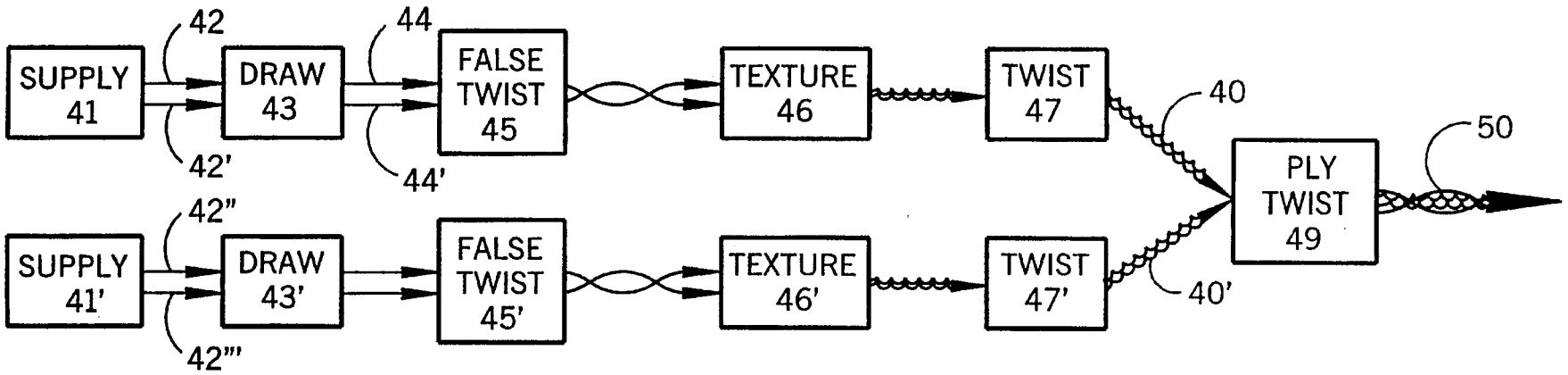
FIG. 1*c* schematically illustrates a fourth embodiment of a process according to the present invention.

Specific embodiments of the present invention are shown in FIGS. 1–1*c*. A first embodiment of the present invention is schematically illustrated in FIG. 1. This embodiment involves supplying 10 in a separate side-by-side parallel relationship to a yarn drawing apparatus first multifilament feed yarn 14 and second multifilament feed yarn 14' which are differently colored or colorable with respect to each other. First feed yarn 14 and second feed yarn 14' are drawn 12 while keeping them in their relatively parallel relationship and separated from each other without permitting them to commingle substantially. By simultaneously false twisting 16 drawn yarns 15 and 15' without commingling, bundle 17, which has a barber pole appearance, is made for feeding to the co-texturing step. Bundle 17 is textured 18 in a texturizing apparatus without commingling the filaments to make nontwisted, noncommingled singles yarn 19 which separately displays the color or colorability of each feed yarn 14 and 14'. This is the simplest embodiment of the present invention. In subsequent steps, singles yarn 19 can further be combined with yarn made from other more conventional processes (such as with one or more heather yarns or one color yarns) to produce ply yarns having unique color effects.

A second embodiment of the present invention is shown in FIG. 1*a*. As in FIG. 1, first feed yarn 20 and second feed yarn 20', which are differently colored or colorable with respect to each other, are supplied 22 in side-by-side parallel separate relationship for drawing 24. Drawn feed yarns 25 and 25' are false twisted 26 and co-textured 27 all the while keeping each feed yarn from substantially commingling with the other. In subsequent twisting step 28, real twist in either S or Z direction is used to make twisted singles yarn 29. The yarn created by this embodiment is advantageously used with other twisted singles yarns of the present invention (as in the fourth embodiment) or conventional twisted singles yarns, e.g., heather yarns or one color yarns. Also, the singles yarn of this embodiment can be combined with two or more other singles yarns to make a multi-ply yarn.

FIG. 1*b* is a schematic drawing of the process steps of a third embodiment of the present invention. This embodiment involves making two singles yarns, each according to the first embodiment, and ply twisting them together in a subsequent step. In this way, three or more distinct colors are displayed in the final ply twisted yarn. (Three colors are displayed when one of the feed yarns used in each singles yarn has the same color.) First feed yarn 31 and second feed yarn 31', which are differently colored or colorable with respect to each other, are supplied 30 in parallel separated relationship without substantial commingling to drawing step 32 followed by false twisting 34 to make bundle 35 which is textured 36 to make singles yarn 37. Similarly, singles yarn 37' is made by supplying 30' first and second feed yarns 31" and 31'", which are differently colored or colorable with respect to each other, to drawing 32', followed by false twisting 34'. False twisted bundle 35' is textured 36' keeping each feed yarn from substantially commingling with the other to make singles yarn 37'. Singles yarns 37 and 37' are ply twisted 38 to make two-ply yarn 39. Two-ply yarn of this embodiment exhibits a space dye effect; i.e., apparent color changes along it length.

FIG. 1*c* schematically illustrates a fourth embodiment of the present invention. In this embodiment, two singles yarns, 40 and 40', are made substantially as shown in the second embodiment illustrated schematically in FIG. 1*a*. That is, first twisted singles yarn 40 is made by supplying 41 in parallel side-by-side relationship and without substantial commingling first and second feed yarns 42 and 42', which are differently colored or colorable with respect to each other, to drawing step 43. After drawing, drawn feeder yarns 44 and 44' are false twisted 45 and then co-textured 46, followed by twisting 47. Similar steps are used to make twisted singles yarn 40'. First and second feed yarns, 42" and 42'", which are differently colored or colorable with respect to each other, are supplied 41' to drawing step 43', false twisting step 45', texturing step 46' followed by twisting step 47' to make twisted singles yarn 40'. Twisted singles yarns 40 and 40' are then ply twisted 49 in the opposite direction of the first real twist to make two ply yarn 50. For example, if the S twist is imparted to singles yarns 40 and 40' then ply twisting 49 is in the Z direction. Two ply yarn 50 has a very chunky appearance when four colors are used, i.e., two different colors in each singles yarns. The level of twist (ply twist) affects the appearance of the ply twisted yarn.

Figures 2, 2A, 2B:
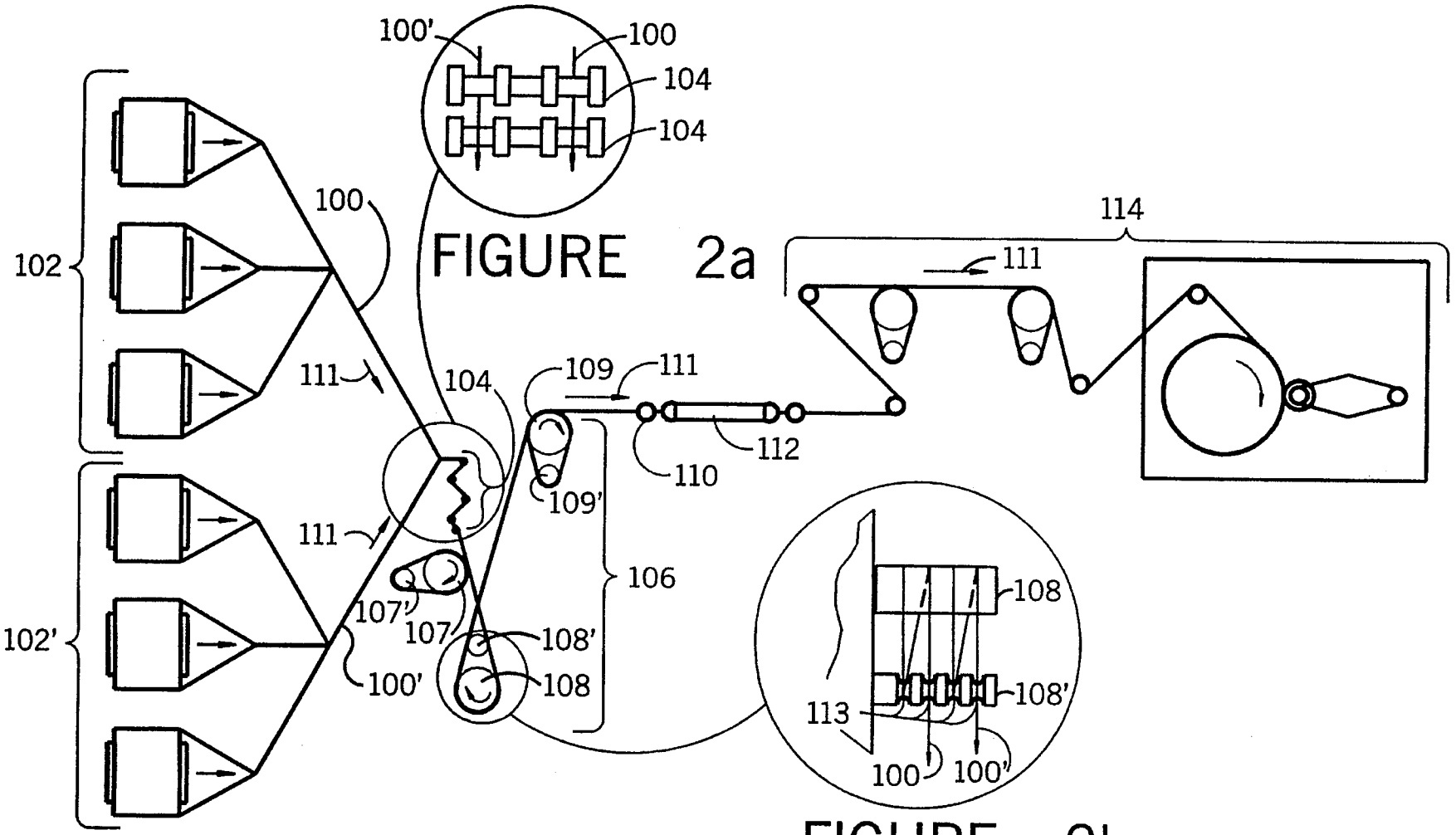
FIG. 2 is another schematic illustration of the process of the present invention.
FIG. 2*a* is a plan view detail of FIG. 2 showing guide pins used to stabilize feed yarns in their respective paths.
FIG. 2*b* is a side-elevational detail of FIG. 2 showing a draw roll/separator roll pair.

FIG. 2 is a schematic representation of the process of the present invention to assist in understanding the presently preferred method of practicing the process steps. In FIG. 2, the yarn travels in the direction of arrows 111. Multifilament feed yarns 100 and 100', which are differently colored or colorable with respect to each other, are supplied by combining three individual unit yarns from creel sets 102 and 102'. First multifilament feed yarn 100 and second multifilament feed yarn 100' are guided over a series of guide pins 104 to stabilize the path of yarn travel and assist to maintain the two multifilament feed yarns separate. Guide pins 104 are located prior to the draw zone so that the side-by-side but separate paths travelled by multifilament yarns 100 and 100' are well stabilized prior to drawing.

In draw zone 106 multifilament feed yarns 100 and 100' maintain their mutually separated relationship during drawing. Drawing takes place according to conventional manners which generally include guiding each yarn over a series of draw rolls which are driven at different rates of speed, thereby stretching and orienting the yarn a pre-determined amount. Individual draw rolls 107, 108 and 109 travel in the direction shown by the arrows inside them. Each draw roll 107, 108 and 109 is shown with respective undriven separator roll 107', 108' and 109'. Following drawing, the two multifilament feed yarns, now drawn, are guided into fluid jet 110 where they are subjected to fluid impingement in a direction tangential to the path the yarn follows. This impingement imparts false twist to feed yarns creating a single bundle with a barber pole appearance. Following false twisting in fluid jet 110, the yarn bundle created from the multifilament feed yarns is passed into thermo-pneumatic texturing device (stuffer box 112) for texturing. Following texturing, the now textured and combined, but not commingled, feed yarns are wound up on winding equipment 114.

FIG. 2*a* is a plan view detail of FIG. 2 showing the relative relationship of guide pins 104 and the independent paths followed by multifilament feed yarns 100 and 100'. As shown in FIG. 2, these guides are arranged to make the yarn travel a zigzag path thereby reducing the amount of side-to-side (rather than forward) motion and stabilizing the yarn in its path.

FIG. 2*b* is a side elevational detail of FIG. 2 showing draw roll 108/separator roll 108' combination. Separator roll 108' is equipped with grooves 113 which help prevent the feed yarns 100 and 100' from commingling. Preferably grooves 113 are rounded rather than square or N-shaped. Square or N-shaped grooves, however, can be used. Grooves 113 are shown greatly exaggerated in FIG. 2*b*.

Figure 3:
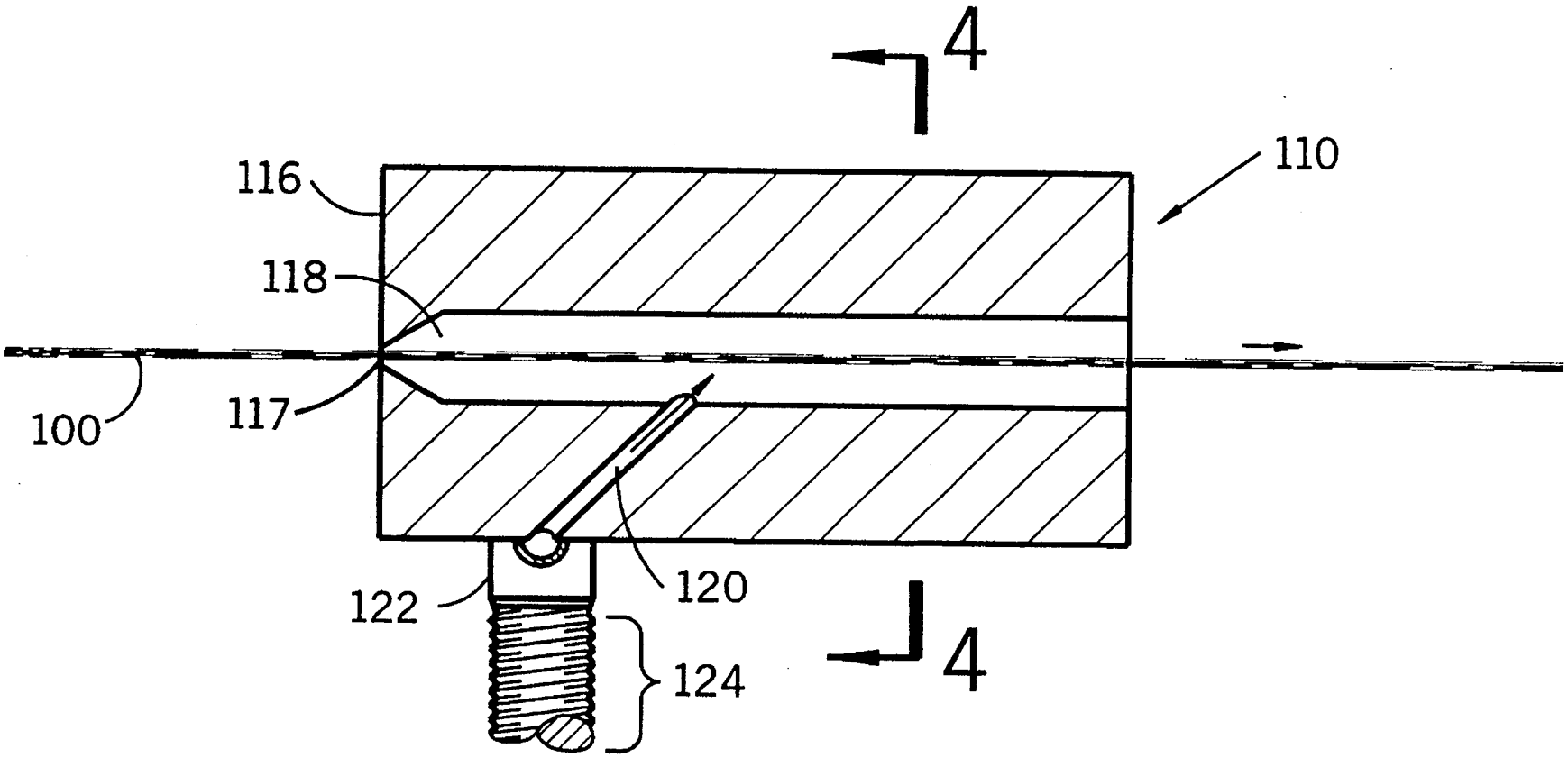
FIG. 3 is a cross-sectional side elevational view of a fluid jet useful in the process of the present invention.

FIG. 3 is a cross-sectional side elevational view of fluid jet 110. This fluid jet is similar to that shown in FIG. 2 of U.S. Pat. No. 2,869,967, although in the present invention, the jet is used for a different purpose than described in that patent. FIG. 3 shows body 116 of fluid jet 110 which is drilled lengthwise to provide axial yarn passage 118. Fluid jet 110 is shown with optionally constricted entrance bore 117. Air entrance 120 is drilled at a forward angle of about 45 degrees through one face of the block to intercept the yarn passage. To impart the desired rotation to the yarn, air entrance 120 is of smaller diameter than yarn passage 118 and is off-center from yarn passage 118 to intercept traveling multifilament drawn feed yarn 100 at the side rather than in the center of the yarn and impart twist to the yarn (this is shown in more detail in FIG. 4). Fitting 122 is present over air entrance 120 and is shown with threading at 124 for attachment to a fluid supply pipe. Preferably the fluid to be supplied is air.

Figure 4:
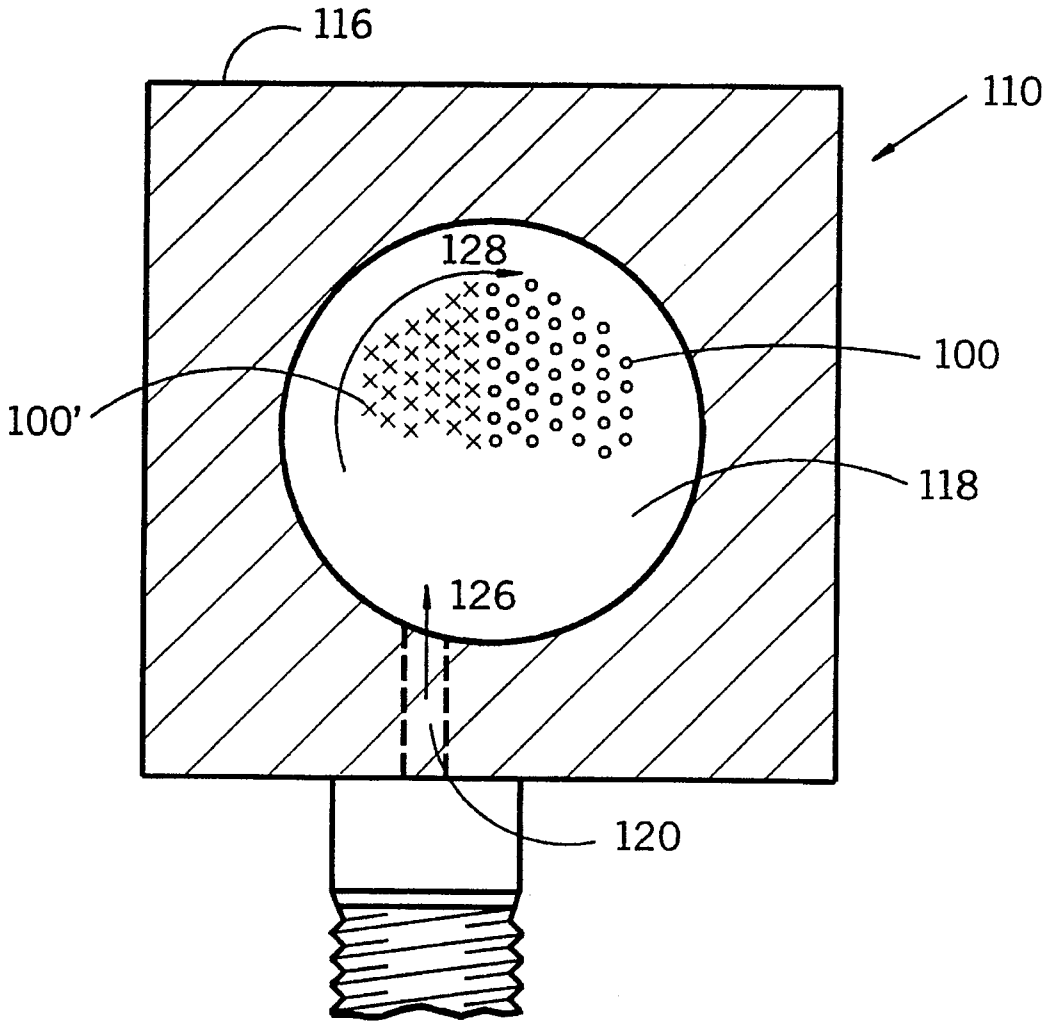
FIG. 4 is a cross-sectional end elevational view of the fluid jet taken along line 4—4 in FIG. 3, looking in the direction of the arrows and showing the relative rotation of two drawn feed yarns in the jet.

FIG. 4 is a cross-sectional end elevational view of jet 110 showing the effect of the side impingement of air on multifilament drawn feed yarns 100 and 100'. Body 116 is provided with axial yarn passage 118. Air entrance 120 is shown in phantom. Air flow is in the direction of arrow 126 into axial yarn passage 118. Since the air provided does not impinge the multifilament feed yarns in the center of the yarn but at its side, rotation is imparted as shown by arrow 128. This tangential air flow creates false twist and prevents commingling during subsequent co-texturing. Although not wishing to be bound by theory, it is believed that this manner of imparting false twist to the separate feed yarns takes any free length out of them, thereby preventing commingling.

The yarn supplied according to the present invention may be any man-made yarn made from fiber forming thermoplastic materials especially polyesters, polyamides and polyolefins. Suitable polyesters include polyethylene terephthalate. Suitable polyamides include nylon 6, nylon 6/6, nylon 6/9, nylon 6/10, nylon 6/12, nylon 11, nylon 12 and copolymers and mixtures thereof. The individual filaments may be of any well-known cross-section, e.g., round, multilobal, hexagonal, elongated, hollow, etc.

Of course, various additives may be used in one or more of the polymers. These include, without limitation, lubricants, nucleating agents, antioxidants, ultraviolet light stabilizers, pigments, dyes, antistatic agents, soil resists, stain resists, antimicrobial agents and flame retardants.

In the process of the present invention and the preceding figures, supplying step is shown accomplished from already wound up feeder yarns such as would occur in a two-step drawtexturing process. The illustration of wound up feed yarn is not considered limiting. The present invention has equal applicability to a one-step spin draw-texture operation where the multifilament feed yarns are fed directly from the spinneret. Any conventional spinning operation can be used to spin the feed yarns.

The individual feed yarns need not be made of the same materials but they should be compatible with respect to shrinkage, crimp level attainable at a given condition, wind tension, etc. Incompatible feed yarns can create undesirable commingling. Preferably, each feed yarn will have a total denier between 300 and 1300 and a denier per filament between 10 and 30 such as typically found in yarns made for tufting into carpet. More preferably, the first and second feed yarns will each have a total denier between 750 and 1100 and a denier per filament between 15 and 25. In a particularly preferred embodiment, several smaller unit yarns are combined to make each multifilament feed yarn (as shown in FIG. 2). For example, when the total denier of the multifilament feed yarns is 750, individual 250 denier unit yarns may be combined to make this feed yarn. Of course, this will depend on the most convenient adaptation to accommodate the present invention of a particular process already in commercial use. It is also contemplated that the multifilament feeder yarns may be heathered when supplied. This is achieved by commingling individual unit yarns that are differently colored or colorable (e.g., three different shades of blue) with respect to each other. When these unit yarns are blended to make a multifilament feed yarn, a heather effect will appear in the feed yarn itself. This permits even more versatility in the unique color effects achieved with the present invention.

As discussed, the feed yarns differ in color or colorability. This can be accomplished by conventional methods of coloring the fiber forming polymer in the melt or by providing differential dyeability, such as by making one feed yarn from regular anionic dye dyeable nylon and the other yarn from cationic dye dyeable nylon, all according to methods well known to those in the art.

As noted, the yarn is advantageously guided through a series of guide pins. These guide pins are preferably ceramic but can be made of other materials as well. Preferably, these pins are grooved and not flat. The grooves help to stabilize the components and prevent them from jumping together before the texturing jet.

The drawing step of the present invention can be accomplished using any conventional draw ratio for the type of fiber being made. When the yarn is nylon 6 yarn, the draw ratio is preferably about 3. But the desirable draw ratio will be apparent to those of ordinary skill in the art. As discussed, drawing preferably includes passing each feed yarn over heated draw rolls paired with grooved separator rolls where the separator rolls have at least one grooved path for each feed yarn to keep the feed yarns separate during drawing. Most preferably, these grooved paths are rounded.

The imparting of false twist to the individual feed yarn is preferably accomplished using a single texturing jet as shown in FIGS. 3 and 4. As noted, this jet supplies fluid to the edge rather than the center of the feed yarns to cause the yarns to rotate. Preferably fluid is supplied at sonic velocity at 70–150 psi, most preferably 90 psi. This jet pulls and forwards the yarns but doesn't intermix (commingle) filaments between them.

The hot co-texturing step of the present invention is preferably accomplished using a thermo-pneumatic stuffer box (in this case a tube) but other texturing methods except interlacing can be used, too. In such a stuffer tube, the yarn is crimped (mechanically bent and folded) because it is supplied into the box faster than it is withdrawn. Warm air with a temperature sufficient to set the crimp is used. In the case of nylon 6, a preferable range of suitable air temperatures is 200°–400° C. Interlacing is not presently considered a desirable texturing method because interlacing commingles the filaments of the respective multifilament feed yarns.

When the singles yarn of the present invention is combined with another singles yarn according to the present invention, the tension applied during the ply twisting operation should preferably be carefully controlled. Also, the singles yarns should be compatible with each other with respect to shrinkage and crimp level if dominance of one over another is to be avoided. Ply twisting is preferably accomplished at a tension of 200–400 grams. Most preferably, the tension differential between the two yarns should never exceed 50 grams. Ply twisting is accomplished according to methods well known to those who are ordinarily skilled in the art. The twist level can be varied to produce various random color highlights in the yarn. For example, the length of the "spaces" in the space dye appearance yarn made by the present invention is varied with twist level. In general, the higher the twist, the shorter the space. The twist level is preferably 2.0–5.0 turns per inch (tpi), most preferably 3.5 tpi.

Yarn made according to the present invention is advantageously used in making carpets. Carpets made from this yarn have clean bold colors that appear randomly as chunks.

This invention will be described by reference to the following detailed examples. The examples are set forth by way of illustration, and are not intended to limit the scope of the invention.

EXAMPLE 1

Four-Color Yarn and Carpets Made From Them

Three multifilament 250 denier (20 denier per filament) gray yarns and three multifilament 250 denier (20 denier per filament) black yarns are combined respectively to make one 750 denier multifilament gray yarn and one 750 denier multifilament black yarn. These yarns are drawn side-by-side without substantial commingling at a draw ratio of 3. Following drawing, the drawn yarns are fed side-by-side into a fluid jet where false twist is imparted to the pair of yarns. The yarns are then co-textured in a thermopneumatic texturing process (stuffer tube), withdrawn as a two-color singles yarn and wound up at a speed of 1387 m/min. This is all accomplished substantially as shown in FIG. 2.

Similarly, a 750 denier multifilament brick red feed yarn and another 750 denier multifilament rust feed yarn are made by combining three 250 denier multifilament component yarns of brick red and rust, respectively. These feed yarns are processed into a two-color singles yarn by drawing them side-by-side at a draw ratio of 3. Following drawing, the draw yarn are fed side-by-side into a fluid jet where they are false twisted. The yarns are then co-textured in a thermo-pneumatic texturing process (stuffer tube), withdrawn as a singles yarn and wound up at a speed of 1387 m/min.

Figure 5:
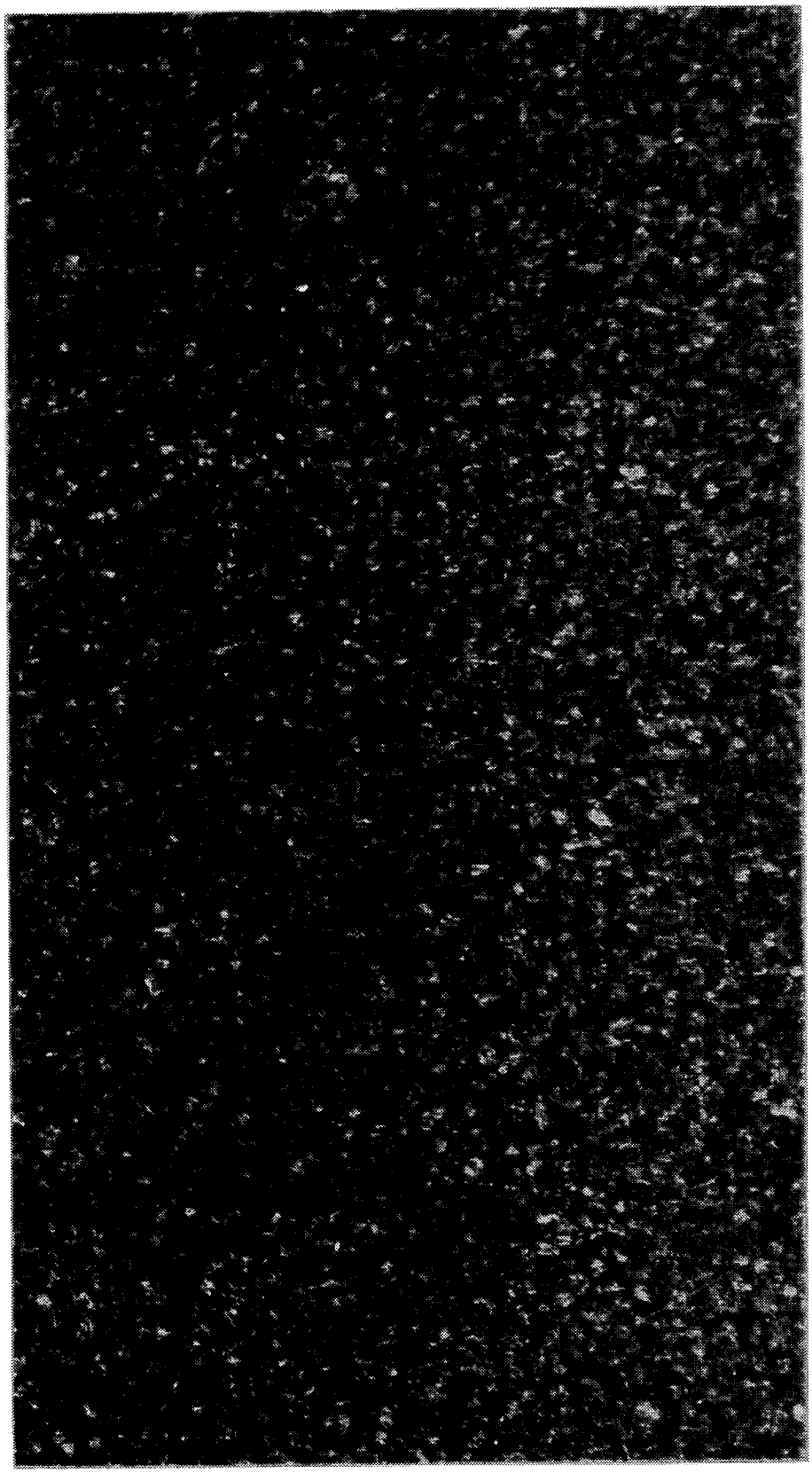
FIG. 5 is a color photograph illustrating a four-color cut pile carpet tufted from yarn made according to the present invention as described in Example 1.
Figure 5A:
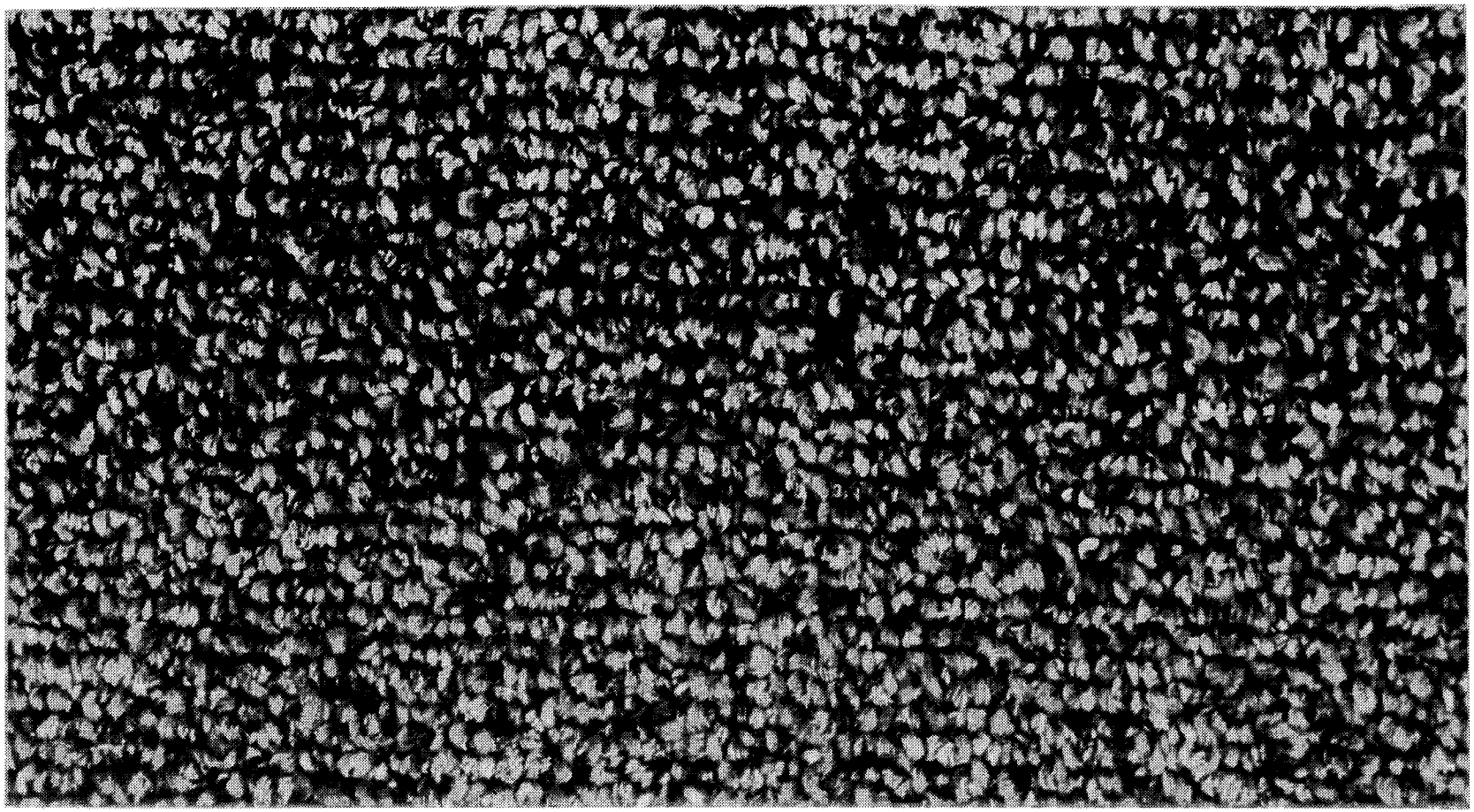
FIG. 5*a* is a color photograph illustrating a four-color level loop carpet tufted from yarn made according to the present invention as described in Example 1.

The gray/black singles yarn is ply twisted at 1.5 tpi in the S direction with the brick red/rust singles yarn to make a three color ply twisted yarn. The yarn is tufted into cut pile carpet (⅜" pile height, 32 oz./yd$^2$) and level loop carpet (9–10 stitches per inch, 24 oz./yd$^2$). The cut pile carpet is shown in FIG. 5. The level loop carpet is shown in FIG. 5*a*.

EXAMPLE 2

Four-Color Yarn and Carpets Made Therefrom

Three multifilament 250 denier beige (20 denier per filament) yarns and three multifilament 250 denier rust (20 denier per filament) yarns are combined respectively to make one 750 denier multifilament beige yarn and one 750 denier multifilament rust yarn. These yarns are drawn side-by-side without substantial commingling at a draw ratio of 3. Following drawing, the drawn yarns are fed side-by-side into a fluid jet where false twist is imparted to the pair of yarns. The yarns are then co-textured in a thermo-pneumatic texturing process (stuffer tube), withdrawn as a singles two-color yarn and wound up at a speed of 1387 m/min. All as shown substantially in FIG. 2.

Similarly, a 750 denier multifilament blue feed yarn and another 750 denier multifilament gray feed yarn are made by combining three 250 denier multifilament component yarns of blue and gray, respectively. These feeder yarns are processed into a two-color singles yarn by drawing them side-by-side at a draw ratio of 3. Following drawing, the draw yarn are fed side-by-side into a fluid jet where they are false twisted. The yarns are then co-textured in a thermo-pneumatic texturing process (stuffer tube), withdrawn as a singles yarn and wound up at a speed of 1387 m/min.

Figure 6:
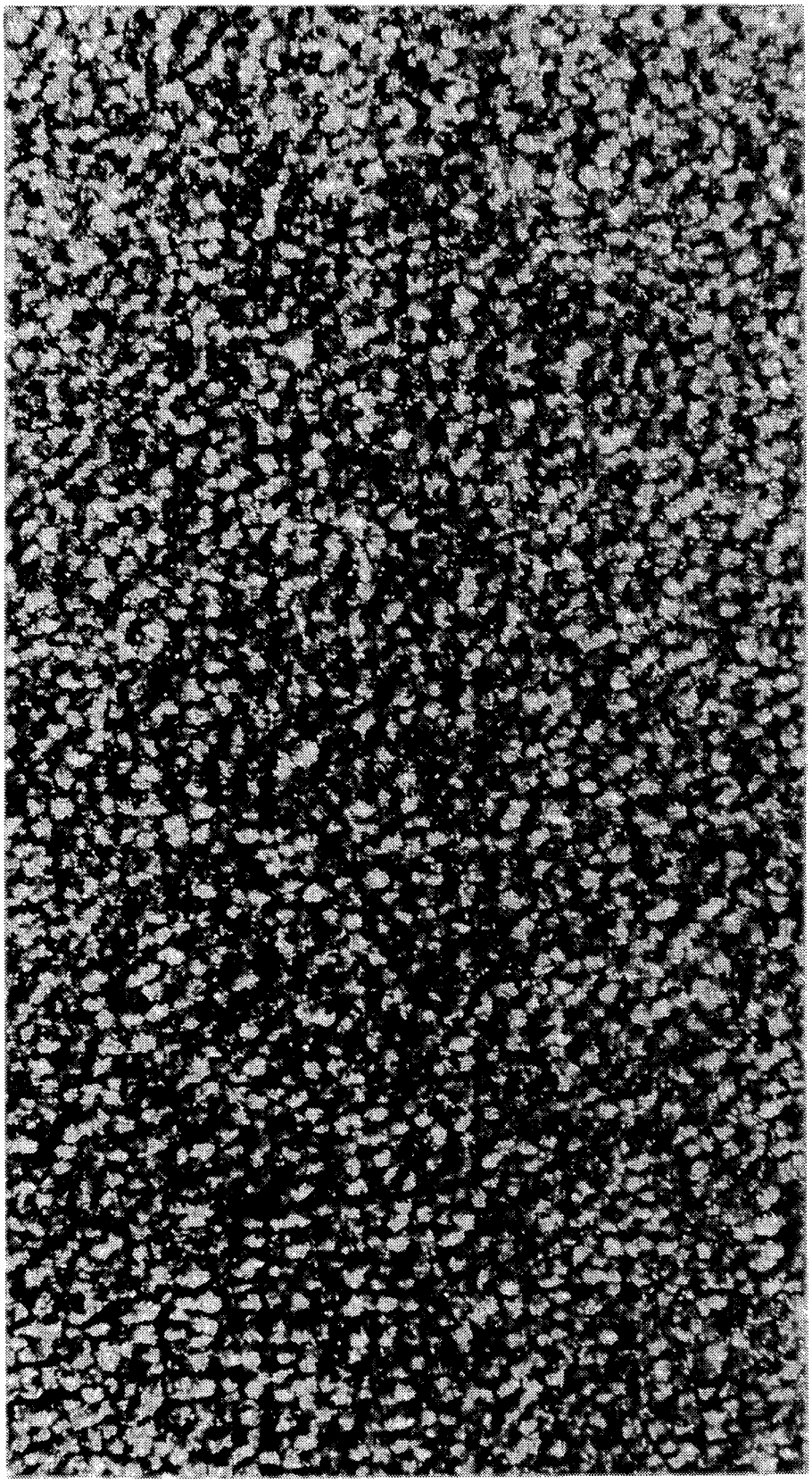
FIG. 6 is a color photograph illustrating another four-color cut pile carpet tufted from yarn made according to the present invention as described in Example 2.
Figure 6A:
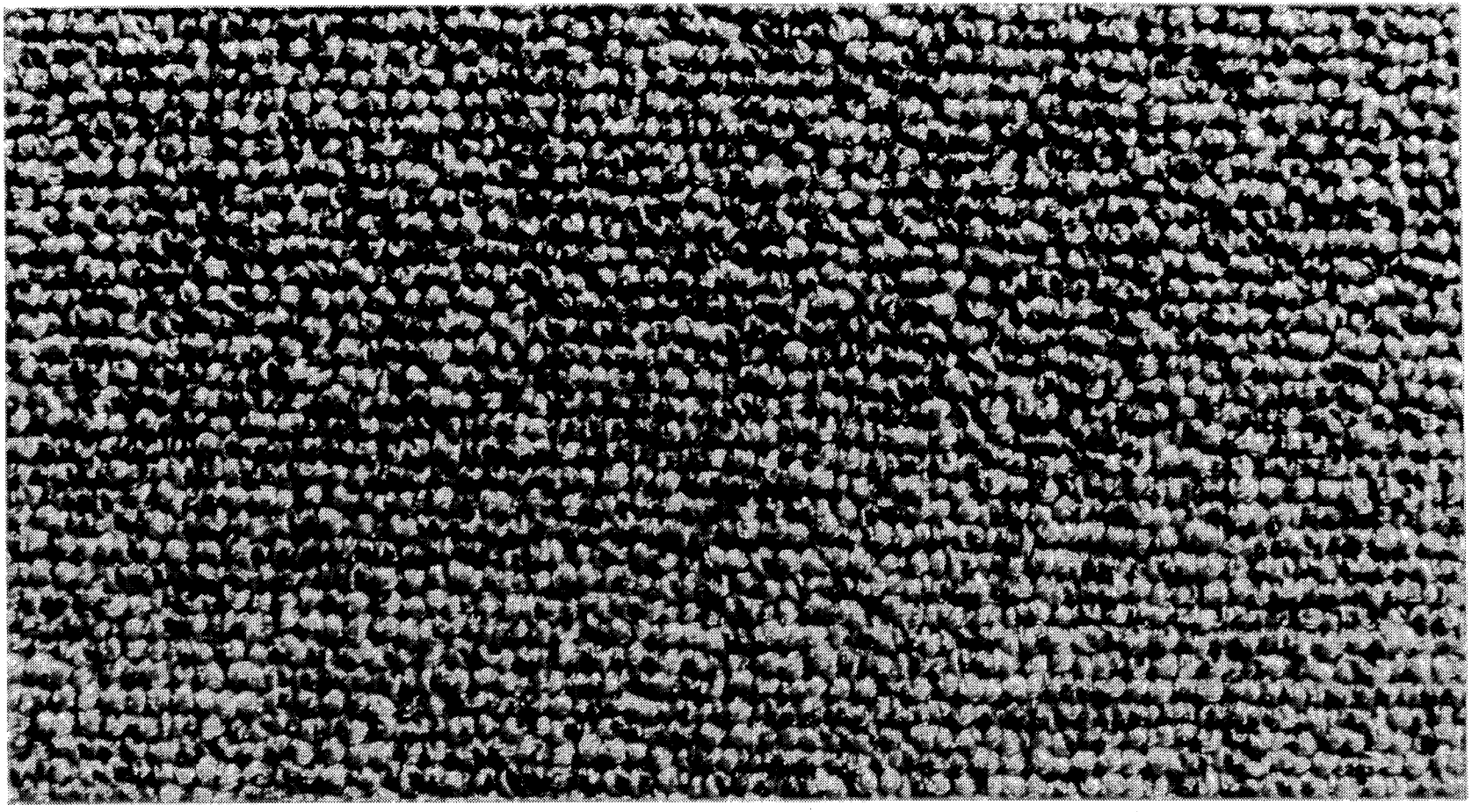
FIG. 6*a* is a color photograph illustrating another four-color level loop carpet tufted from yarn made according to the present invention as described in Example 2.

The beige/rust singles yarn is ply twisted at 1.5 tpi in the S direction with the blue/gray singles yarn to make a four color ply twisted yarn. The yarn is tufted into cut pile carpet (⅜" pile height, 32 oz./yd$^2$) and level loop carpet (9–10 stitches per inch, 24 oz./yd$^2$). The cut pile carpet is shown in FIG. 6. The level loop carpet is shown in FIG. 6*a*.

EXAMPLE 3

Chunky Four-Color Yarn

Four multifilament 250 denier dark pink (20 denier per filament) yarns and four multifilament 250 denier yellow (20 denier per filament) yarns are combined respectively to make one 1000 denier multifilament dark pink yarn and one 1000 denier multifilament yellow yarn. These yarns are drawn side-by-side without substantial commingling at a draw ratio of 3. Following drawing, the drawn yarns are fed side-by-side into a fluid jet where opposing false twist is imparted to the pair of yarns. The yarns are then co-textured in a thermo-pneumatic texturing process (stuffer tube), withdrawn as a two-color singles yarn, twisted 3.5 turns per inch in the S direction and wound up at a speed of 1387 m/min. This is all accomplished substantially in FIG. 2.

Similarly, a 1000 denier multifilament black feed yarn and another 1000 denier multifilament blue feed yarn are made by combining four 250 denier multifilament component yarns of black and blue, respectively. These feeder yarns are processed into a two-color singles yarn by drawing them side-by-side at a draw ratio of 3. Following drawing, the draw yarn are fed side-by-side into a fluid jet where opposing false twist is made into the pair of yarns. The yarns are then co-textured in a thermo-pneumatic texturing process (stuffer box), withdrawn as a singles yarn, twisted at 3.5 turns per inch in the S direction and wound up at a speed of 1387 m/min.

The dark pink/yellow singles yarn is ply twisted at 1.5 tpi in the Z direction with the blue/black singles yarn to make a four color ply twisted yarn. The yarn has a very chunky appearance.

What is claimed is:

1. A process comprising the sequential steps of:

(a) supplying in a separated side-by-side parallel relationship to a yarn drawing apparatus first multifilament feed yarn and second multifilament feed yarn which are differently colored or colorable with respect to each other;

(b) drawing the first feed yarn and the second feed yarn in the yarn drawing apparatus while keeping the first feed yarn and the second feed yarn in a relatively parallel relationship and separate from each other;

(c) making a bundle from the first drawn feed yarn and the second drawn feed yarn by simultaneously imparting false twist to the drawn first feed yarn and the drawn second feed yarn without commingling the first and second drawn feed yarns; and (d) texturing the bundle without commingling to make a nontwisted, noncommingled singles yarn displaying two distinct unblended colors.

2. The process of claim 1 wherein said first and second multifilament feed yarns each have a total denier between 300 and 1300 and a denier per filament between 10 and 30.

3. The process of claim 2 wherein said first and second multifilament feed yarns each have a total denier between 750 and 1100 and a denier per filament between 15 and 25.

4. The process of claim 3 wherein said supplying includes combining together a first set of similar unit yarn to make the first multifilament feed yarn and combining together a second set of similar unit yarn to make an equal amount of the second multifilament feed yarn.

5. The process of claim 4 wherein the first set of unit yarn includes unit yarns which are differently colored or colorable with respect to each other such that the first multifilament feed yarn is a heathered yarn.

6. The process of claim 1 wherein said supply includes passing each feed yarn through a series of guide pins prior to said drawing.

7. The process of claim 1 wherein said drawing includes passing the first and second multifilament feed yarns over heated draw rolls and corresponding separator rolls which separator rolls have at least one grooved path for each multifilament feed yarn thereby keeping the multifilament feed yarns separate during said drawing.

8. The process of claim 7 wherein the grooved paths are rounded.

9. The process of claim 1 wherein said imparting is accomplished in a single fluid texturing jet which supplies fluid to an edge of each multifilament feed yarn thereby causing each yarn to rotate.

10. The process of claim 1 wherein said texturing is by stuffing the bundle into a stuffer box faster than the bundle is removed from the stuffer box and applying heat to set crimp developed by said stuffing.

11. The process of claim 10 wherein the stuffer box is a thermo-pneumatic stuffer box.

12. The process of claim 1 further comprising:

(e) making a second singles yarn by applying steps (a)–(d); and (f) twisting the second singles yarn with the first singles yarn with tension applied to the first singles yarn and the second singles yarn.

13. The process of claim 12 wherein the tension applied to the first singles yarn is within 50 grams of the tension applied to the second singles yarn.

14. The process of claim 12 further comprising:

(g) applying S or Z twist to the first and second singles yarns prior to said twisting and wherein said twisting results in twist opposite to the twist applied to each singles yarns.

15. A process comprising the sequential steps of:

(a) supplying to a draw roll first multifilament feed yarn having a total denier of 300 to 1300 and a denier per filament of 10 to 30 and second multifilament feed yarn having a total denier of 300 to 1300 and a denier per filament of 10 to 30, which feed yarns are differently colored or colorable with respect to each other, in a separated side-by-side parallel relationship in independent paths through a series of guide pins;

(b) drawing the first feed yarn and the second feed yarn at the draw rolls while keeping the first feed yarn and the second feed yarn in a relatively parallel relationship and separated from each other by passing each feed yarn over grooved separator rolls corresponding to the draw rolls and which have separate groove paths for each yarn;

(c) making a bundle from the first drawn feed yarn and the second drawn feed yarn by simultaneously in a single fluid jet imparting false twist to the drawn first feed yarn and the drawn second feed yarn without commingling the first and second drawn feed yarns; and (d) texturing the bundle in a thermo-pneumatic stuffer box without commingling filaments between the bundles to make a nontwisted, noncommingled singles yarn.

16. The process of claim 15 further comprising (e) making a second singles yarn by applying steps (a)–(d); and (f) twisting the second singles yarn with the first singles yarn with tension applied to the first singles yarn and the second singles yarn.

17. The process of claim 16 wherein the tension applied to the first singles yarn is within 50 grams of the tension applied to the second singles yarn.

18. The process of claim 16 further comprising (g) applying S or Z twist to the first and second singles yarns prior to said twisting and wherein said twisting results in twist opposite to the twist applied to the singles yarns.

* * * * *